US008475192B2

(12) United States Patent
Kantor

(10) Patent No.: US 8,475,192 B2
(45) Date of Patent: Jul. 2, 2013

(54) BUSHING SEAL FOR REEFER PLUG

(76) Inventor: John F. Kantor, Hobe Sound, FL (US)

( * ) Notice: Subject to any disclaimer, the term of this patent is extended or adjusted under 35 U.S.C. 154(b) by 0 days.

(21) Appl. No.: 13/227,791

(22) Filed: Sep. 8, 2011

(65) Prior Publication Data

US 2013/0065416 A1 Mar. 14, 2013

(51) Int. Cl.
*H01R 13/52* (2006.01)

(52) U.S. Cl.
USPC ..... 439/273; 439/442

(58) Field of Classification Search
USPC ..... 439/273, 274, 277, 442, 447, 454, 439/462, 598
See application file for complete search history.

(56) References Cited

U.S. PATENT DOCUMENTS 2,963,536 A * 12/1960 Kokalas ..... 174/77 R
3,344,227 A * 9/1967 Gilmartin et al. ..... 174/88 C
3,603,912 A * 9/1971 Kelly ..... 439/273
3,624,591 A * 11/1971 Buberniak ..... 439/462
3,904,812 A * 9/1975 Daffron ..... 174/549
4,781,617 A * 11/1988 Alibert ..... 439/461
5,567,174 A * 10/1996 Ericson et al. ..... 439/462
5,573,423 A * 11/1996 Lin et al. ..... 439/462
5,893,777 A * 4/1999 Kantor ..... 439/550
6,019,636 A * 2/2000 Langham ..... 439/584
6,045,383 A * 4/2000 Fujiwara ..... 439/271
2004/0121650 A1* 6/2004 Lazaro, Jr. ..... 439/598
2009/0237258 A1* 9/2009 Heck et al. ..... 340/585

* cited by examiner

*Primary Examiner* — James Harvey
(74) *Attorney, Agent, or Firm* — Novak Druce Connolly Bove + Quigg LLP

(57) ABSTRACT

A bushing for a reefer plug includes an annular body having proximal and distal ends and an interior conduit for receiving an electrical cable. A distal circumferential seal portion is at the distal end, the distal circumferential seal inclining radially outwardly in the distal to proximal direction. A reefer plug assembly and method for connecting an electrical cable to a reefer plug are also disclosed.

3 Claims, 2 Drawing Sheets

BUSHING SEAL FOR REEFER PLUG

FIELD OF THE INVENTION

This invention relates generally to reefer plugs, and more particularly to sealing systems for reefer plugs.

BACKGROUND OF THE INVENTION

Refrigerated containers or "reefers" are widely used in the transport and cargo industry to move refrigerated perishable goods, particularly food and beverage goods but also other non-consumables that are temperature sensitive. Examples of such reefer plugs are those made by ERO, Inc. of Riviera Beach, Fla. These plugs are units which connect a high voltage (such as 480V, 32 A) electrical cable to a receptacle on the refrigerated container to power the refrigeration unit. The reefer plug is commonly male and the receptacle is commonly female. Such plugs are used on ships, trains and trucks and are subjected to many stresses owing to weather conditions and rough handling by workers. The exposed cable wires where connected to the plug are protected from the elements by the outer casing of the plug. The cable enters the plug casing through a suitable aperture, which is sealed with silicone or other materials to prevent water intrusion at the aperture. The sealing process must be repeated, however, every time the plug is changed or the seal is broken, which is not uncommon given the conditions in which such plugs operate.

SUMMARY OF THE INVENTION

A bushing for an electrical plug includes an annular body having proximal and distal ends and an interior conduit for receiving an electrical cable. A distal circumferential seal portion is provided at the distal end. The distal circumferential seal inclines radially outwardly in the distal to proximal direction. A proximal circumferential seal can be provided at the proximal end. The proximal circumferential seal inclines radially outwardly in the proximal to distal direction. A radially extending sealing flange between the distal circumferential seal and the proximal circumferential seal can also be provided. The bushing can be made from a polymer such as rubber.

An electrical plug assembly can include a plug body having a distal end and a proximal end, the plug body having an open interior portion for receiving an electrical cable from the distal end, and at least one electrical plug at the proximal end, and an electrical connector within the plug body for electrically connecting the cable to the electrical plug. The plug can be a reefer plug with male prongs. A plug cap has an interior opening for receiving the electrical cable. The plug cap has structure for engaging the distal end of the plug body. The cap can further include a sealing portion adjacent the interior opening. A bushing includes an annular body having proximal and distal ends and an interior conduit for receiving the electrical cable, and a distal circumferential seal portion at the distal end. The distal circumferential seal inclines radially outwardly in the distal to proximal direction. The bushing is interposed between the cap and the plug with the sealing portion of the cap in sealing contact with the distal circumferential seal of the bushing.

A proximal circumferential seal can be provided at the proximal end of the bushing. The proximal circumferential seal inclines radially outwardly in the proximal to distal direction. The distal end of the plug body can include a circumferential sealing portion that inclines radially outwardly in the proximal to distal direction. The bushing can further include a radially extending sealing flange between the distal circumferential seal and the proximal circumferential seal.

A method for connecting an electrical cable to an electrical plug includes the step of providing a plug body having a distal end and a proximal end, the plug body having an open interior portion for receiving an electrical cable from the distal end. At least one electrical plug is positioned at the proximal end. An electrical connector within the plug body is provided for electrically connecting the cable to the electrical plug. A plug cap is provided and has an interior opening for receiving the electrical cable. The plug cap has structure for engaging the distal end of the plug body, and has a sealing portion adjacent the interior opening. A bushing is provided with an annular body having proximal and distal ends and an interior conduit for receiving the electrical cable. The bushing has a distal circumferential seal portion at the distal end, the distal circumferential seal inclining radially outwardly in the distal to proximal direction. The bushing is interposed between the cap and the plug with the sealing portion of the cap in sealing contact with the distal circumferential seal of the bushing. An end of the electrical cable is placed through the interior opening of the cap, and through the interior conduit of the bushing. The cable is electrically connected to the electrical connector of the plug body. The cap is connected to the distal end of the plug body, such that the distal circumferential seal of the bushing contacts the sealing portion of the cap to form a watertight seal between the cap and the bushing and between the cap and the plug body.

The bushing can have a proximal circumferential seal at the proximal end, the proximal circumferential seal inclining radially outwardly in the proximal to distal direction. The method can further comprise the step of positioning the proximal circumferential seal against the distal end of the plug body. The distal end of the plug body can have a circumferential sealing portion that inclines radially outwardly in the proximal to distal direction, the proximal circumferential seal of the bushing being mated with the distal circumferential seal of the plug body. A radially extending sealing flange between the distal circumferential seal and the proximal circumferential seal of the bushing can be provided. The sealing flange can be mated to a rim of the distal end of the plug body and to a portion of the cap surrounding the interior opening. The electrical plug can be a reefer plug.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 3:
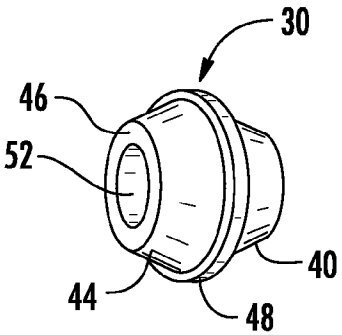
FIG. 3 is a perspective view of a universal bushing for a reefer plug according to an aspect of the invention.

There is shown in FIGS. 1-8 a reefer plug assembly according to the invention. The reefer plug assembly includes a plug body 10, a bushing 30, and a cap 34. The plug body 10 includes a proximal end 14 that is proximal to the receptacle or other type of electrical connection that is to be made with the plug. In a common reefer plug construction, an electrical connector 36 is provided within the plug body 10 with one of more screws, clamps or other conducting members which engage the electrical wires that are exposed at the end of an electrical cable 38. The connector 36 can have suitable electrical connecting structure associated therewith such as male prongs 41 that are shown or female receptacles or other connecting structure. The cable 38 when connected to the reefer plug can then be readily connected to a cooperating electrical connector, such as a cooperating female receptacle on a reefer container as are used to transport cargo on ships, trucks and trains. The invention also has utility for other types of connectors, wherever an electrical cable is to be joined to a receptacle or other connector of some kind.

The plug body 10 has a distal end 16 that is opposite the proximal end 14. The distal end 16 has connecting structure 20 at the distal end 16 for connecting to cooperating connecting structure on the cap 34. The cooperating connecting structure is preferably incrementally adjustable, and can be infinitely adjustable within a given range. In the embodiment that is shown, the distal end 16 of the plug body 10 can have threads 22 providing the connecting structure 20. Threads 62 can be provided on an interior surface of the cap 34 and cooperate to engage the threads 22 on the plug body 10 to secure the cap 34 to the distal end 16 of the plug body 10. The threads provide for incremental advancement of the cap 34 toward the plug body 10, such that the cap 34 can be advanced until the desired pressure on the bushing 30 is attained. The cooperating threads 22 and 62 provide an almost infinite adjustability within a range. Other means for securing and incrementally advancing the cap 34 to and toward the plug body 10 are possible. The cap 34 is removed to provide access to the interior of the plug body 10 such that exposed wire ends of the electrical cable 38 can be connected to the electrical connector of the plug body 10. The cap 34 can then be replaced to close the interior of the plug body to the elements, and particularly water and salt water spray. The cap 34 has an interior opening 37 to permit the ingress of the electrical cable 38.

The bushing 30 of the invention provides a fast and effective seal between the cap 34 and the electrical cable 38, and between the cap 34 and the plug body 10. The bushing 30 can have a proximal circumferential seal 40 and a distal circumferential seal 44. The proximal circumferential seal 40 inclines radially outwardly in the proximal to distal direction. The distal circumferential seal 44 inclines radial outwardly in the distal to proximal direction. The degree of incline can vary. In one aspect, the angle of incline relative to a horizontal axis as would also extend through the electrical cable 38 is between about 20-80 degrees, or between about 30-70 degrees, or between about 40-60 degrees. The diameter, width and length of the bushing 30 can vary depending on the application and the dimensions of the plug and cable that are being sealed.

Figure 1:
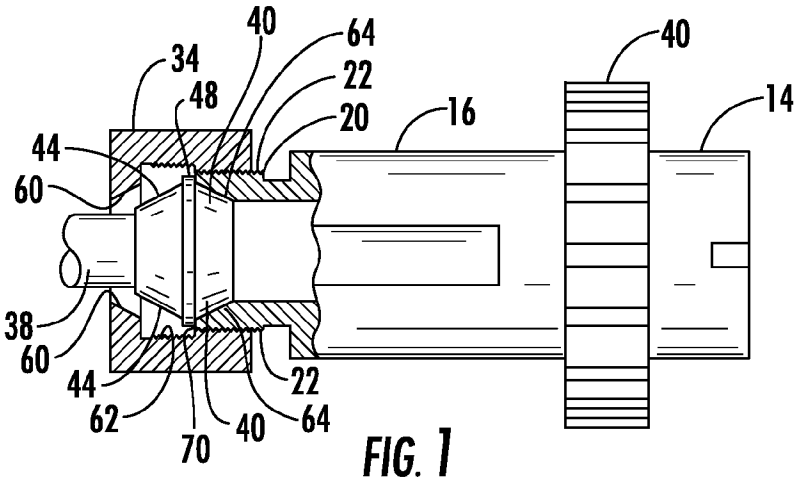
FIG. 1 is a side elevation, partially broken away, of a reefer plug and universal bushing according to the invention.
Figure 2:
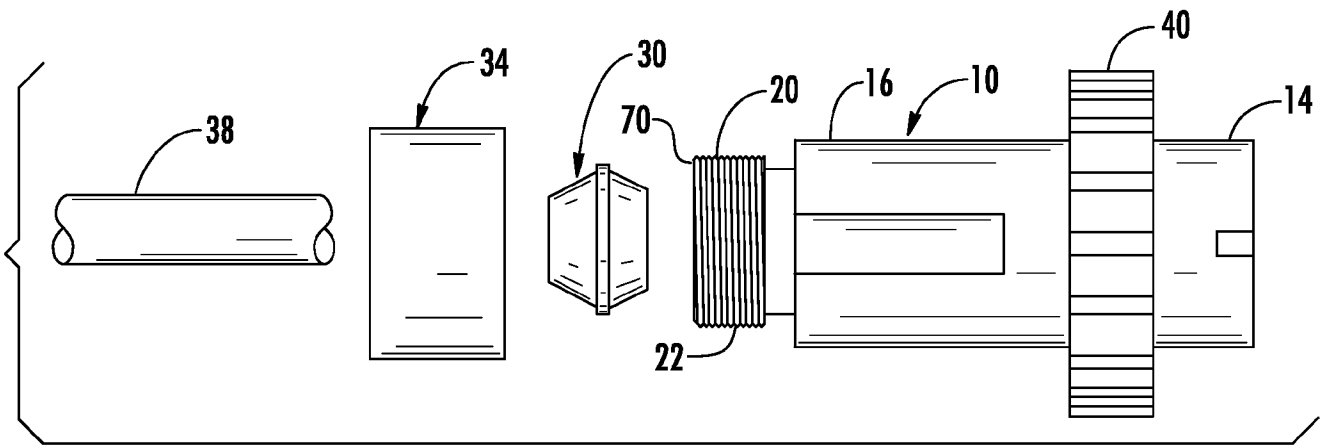
FIG. 2 is an exploded perspective.
Figure 4:
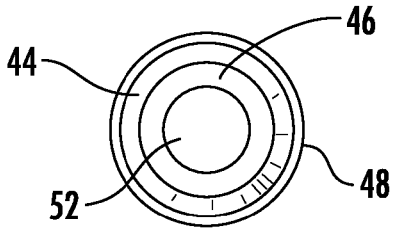
FIG. 4 is a front elevation.
Figure 5:
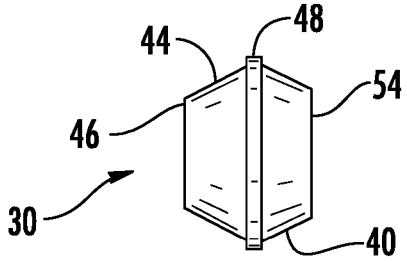
FIG. 5 is a side elevation.

A blunt end portion 46 at the distal end of the bushing 30 can be dimensioned according to the size of the interior opening in the cap 34, and a blunt end portion 54 at the proximal end of the plug body 10 can be provided to abut the distal end 16 of the plug body 10. A radially extending flange 48 is provided between the proximal circumferential seal 40 and the distal circumferential seal 44 of the bushing 30. The radially extending flange 48 can abut a rim 70 of the distal end 16 of the plug body 10 and a surface of the cap 34 surrounding the interior opening (FIG. 1). The cap 34 has a circumferential seal surface 60 about the interior opening 37. The circumferential seal 60 can be an inclined surface that inclines radially outwardly in the distal to proximal direction, such the circumferential seal 60 of the cap 34 will mate with and form a seal with the circumferential seal 44 of the bushing 30. As the cap 34 is tightened the circumferential seal surface 60 is forced into engagement with the circumferential seal surface 44 of the bushing 44. Also, the proximal circumferential seal surface 40 is forced into engagement with the distal end 16 of the plug body 10. The distal end 16 of the plug body 10 can have a circumferential seal surface 64 that inclines radially outward in the proximal to distal direction. The proximal circumferential seal surface 40 of the bushing 30 will mate and seal with the circumferential surface 64 of the distal end 16 of the plug body 10.

The bushing 30 is generally annular and has an interior conduit 52 that is dimensioned to receive the electrical cable 38. The interior conduit 52 has an inside diameter that is substantially the same as the outside diameter of the electrical cable 38, so the connection is substantially water tight. The inside diameter of the conduit 52 is preferably no more than 5%, and preferably no more than 2%, 1%, or ½%, of the outside diameter of the cable 38.

In one aspect the bushing 30 is made from a polymer. Many different polymers are suitable, including polymers with some elasticity such as rubber such that the electrical cable 38 can be tightly fit into the conduit 52 of the bushing 30 and the elasticity of the bushing material will allow some give.

Figure 6:
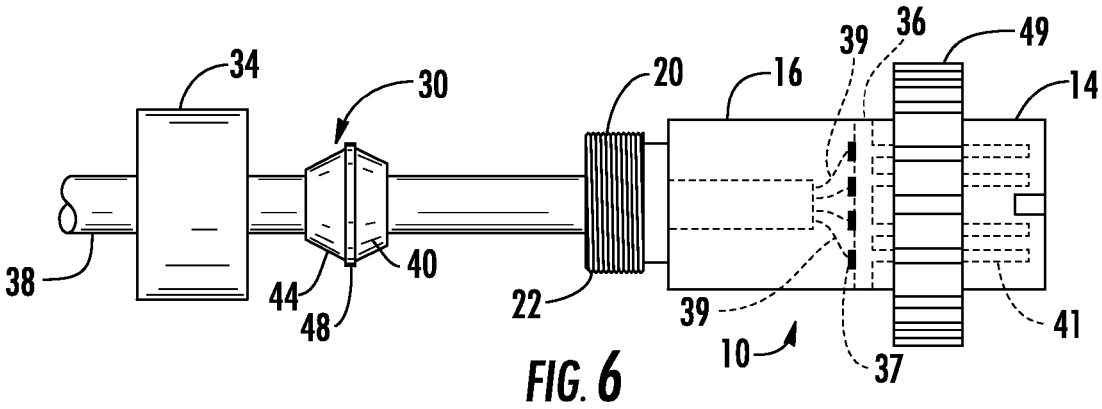
FIG. 6 is a side elevation of a reefer plug and universal bushing according to an aspect of the invention at a first stage of assembly.
Figure 7:
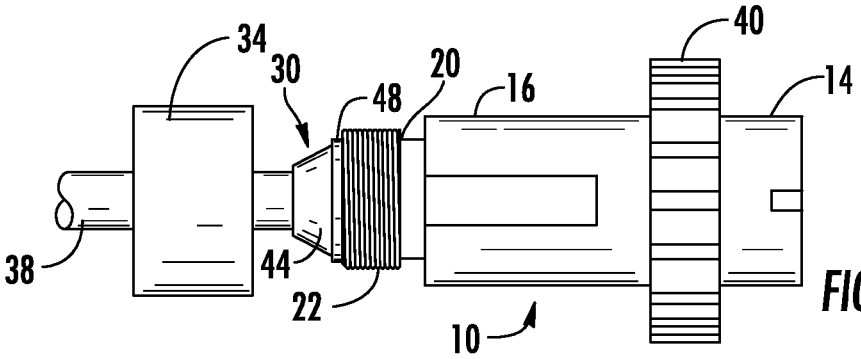
FIG. 7 is a side elevation at a second stage of assembly.
Figure 8:
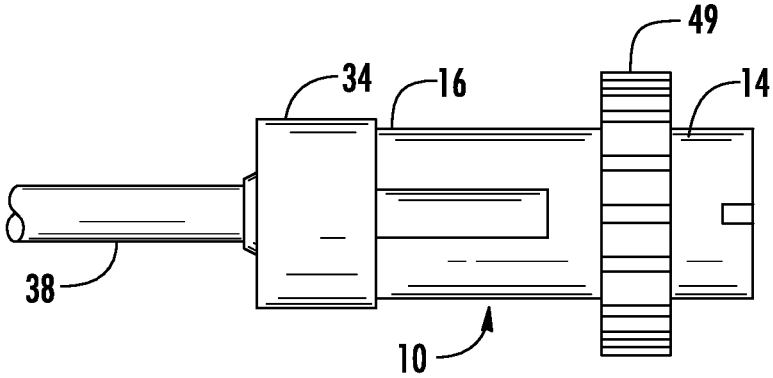
FIG. 8 is a side elevation of a completed assembly.

The method of the invention is illustrated in FIGS. 6-8. The free end of the cable 38 is positioned next to the plug body 10, and the cap 34 and bushing 30 are threaded onto the cable 38. The cable wires 39 are exposed if not already exposed by trimming back the outer cable sheath, and attached to suitable attachment structure such as screws 37, clamps or the like (FIG. 6) on the connector 36. The bushing 30 is then moved into position adjacent the distal end 16 of the plug body 10, with the proximal circumferential seal in sealing contact with the circumferential seal surface 64 of the plug body 10 and the flange 48 in contact with the rim 70 (FIG. 7). The cap 34 is then moved into contact with the bushing 30 such that the circumferential seal 60 contacts the distal sealing surface 44 of the bushing 30, and the cap is tightened as by cooperating threads 22 on the plug body 10 and threads 62 on the cap 34 to seal the assembly against intrusion by water and other contaminants (FIG. 8). A ring connector 49 or other structure can then be turned to secure the plug body 10 to the receptacle.

The foregoing description of the preferred embodiments of the invention has been presented for purposes of illustration. The invention is not limited to the embodiments disclosed. Modifications and variations to the disclosed embodiments are possible and within the scope of the invention. In particular, the invention has utility not only for reefer plugs, but for connecting other types of plugs to electrical conductors and cables.

I claim:

1. An electrical reefer plug assembly, comprising:

a reefer plug body having a distal end and a proximal end, the reefer plug body having an open interior portion for receiving an electrical cable from the distal end, and at least one electrical plug at the proximal end, and an electrical connector within the reefer plug body for electrically connecting the cable to the electrical plug, the distal end of the reefer plug body comprising a circumferential sealing portion that inclines radially outwardly in the proximal to distal direction;

a plug cap having an interior opening for receiving the electrical cable, the plug cap having structure for engaging the distal end of the plug body, the structure for engaging the distal end of the plug body being incrementally adjustable, the cap comprising a sealing portion adjacent the interior opening, the sealing portion of the cap comprising a sealing surface inclining radially outwardly in the distal to proximal direction;

an elastic polymer bushing comprising an annular body having proximal and distal ends and an interior conduit for receiving the electrical cable, a distal circumferential seal portion at the distal end, the distal circumferential seal inclining radially outwardly in the distal to proximal direction, a proximal circumferential seal at the proximal end, the proximal circumferential seal inclining radially outwardly in the proximal to distal direction, the bushing being interposed between the cap and the plug with the sealing portion of the cap in sealing contact with the distal circumferential seal of the of the bushing, the bushing comprising a radially extending sealing flange between the distal circumferential seal and the proximal circumferential seal, the flange having a longitudinal length and the bushing having a longitudinal length, the longitudinal length of the flange being no more than thirty percent of the longitudinal length of the bushing.

2. The assembly of claim 1, wherein the bushing is made from a rubber.

3. A method for connecting an electrical cable to a reefer plug, comprising the steps of:

providing a reefer plug body having a distal end and a proximal end, the reefer plug body having an open interior portion for receiving an electrical cable from the distal end, and at least one electrical plug at the proximal end, and an electrical connector within the reefer plug body for electrically connecting the cable to the electrical plug;

providing a plug cap having an interior opening for receiving the electrical cable, the plug cap having structure for engaging the distal end of the plug body, the cap comprising a sealing portion adjacent the interior opening;

providing an elastic polymer bushing comprising an annular body having proximal and distal ends and an interior conduit for receiving the electrical cable, a distal circumferential seal portion at the distal end, the distal circumferential seal inclining radially outwardly in the distal to proximal direction, the bushing being interposed between the cap and the plug with the sealing portion of the cap in sealing contact with the distal circumferential seal of the of the bushing, the bushing comprising a proximal circumferential seal at the proximal end, the proximal circumferential seal inclining radially outwardly in the proximal to distal direction, the method comprising the step of positioning the proximal circumferential seal against the distal end of the plug body, the distal end of the plug body comprising a circumferential sealing portion that inclines radially outwardly in the proximal to distal direction, the proximal circumferential seal of the bushing being mated with the distal circumferential seal of the plug body;

placing an end of the electrical cable through the interior opening of the cap, and through the interior conduit of the bushing, and electrically connecting the end of the cable to the electrical connector of the plug body;

connecting the cap to the distal end of the plug body so as to elastically deform the bushing and form a watertight seal between the electrical cable and the bushing, and such that the distal circumferential seal of the bushing contacts the sealing portion of the cap to form a watertight seal between the cap and the bushing and between the cap and the plug body, the bushing comprising a radially extending sealing flange between the distal circumferential seal and the proximal circumferential seal of the bushing, the flange having a longitudinal length and the bushing having a longitudinal length, the longitudinal length of the flange being no more than thirty percent of the longitudinal length of the bushing, the sealing flange being mated to a rim of the distal end of the plug body and to a portion of the cap surrounding the interior opening.

* * * * *